United States Patent [19]

Connelly, Jr.

[11] 3,969,255

[45] July 13, 1976

[54] PIPE CLEANING COMPOSITION

[76] Inventor: George F. Connelly, Jr., Golf Road & Perkins Blvd., Grand Beach, Mich. 49117

[22] Filed: Apr. 1, 1974

[21] Appl. No.: 456,468

[52] U.S. Cl. ..... 252/87; 21/2.5 R; 134/22 R; 134/22 C; 134/42; 252/14; 252/148; 252/149

[51] Int. Cl.[2] ..... C02B 5/06; C02B 5/02

[58] Field of Search ..... 252/87, 141, 148, 149, 252/181; 21/2.5; 134/22 R, 22 C, 42, 41

[56] References Cited

UNITED STATES PATENTS

| | | | |
|---|---|---|---|
| 2,203,649 | 6/1940 | Felkers | 252/149 |
| 2,459,119 | 1/1949 | Rucker | 252/149 |
| 3,579,447 | 5/1971 | Muzyczko et al. | 252/87 |
| 3,619,125 | 11/1971 | Porwancher | 252/149 |
| 3,794,523 | 2/1974 | Thompson | 252/87 |
| 3,803,042 | 4/1974 | Knox et al. | 252/187 |

OTHER PUBLICATIONS

Desai, N. M., Rana, S. S.; Inhibition of the Corrosion of Copper in Hydrochloric Acid Solutions, in Chem. Abs. vol. 66, p. 8517, (91073c), 1967.

Desai, N. M., Rana, S. S.; Inhibition of Copper in Hydrochloric Acid Solutions, in Chem. Abs. vol. 66 (51598w), p. 51599, 1967.

Streicher, M. A.; Synergistic Inhibition of Ferric Ion Corrosion During Chemical Cleaning of Metal Surfaces, in Nat. Ass. of Corrosion Engineers, vol. 28, No. 4 (1972), pp. 143–148.

*Primary Examiner*—Mayer Weinblatt

*Attorney, Agent, or Firm*—Merriam, Marshall, Shapiro & Klose

[57] ABSTRACT

A pipe cleaning composition containing hydrochloric acid, furfural, dialkylthiourea, benzyl thiocyanate and water has a reduced tendency to attack steel or copper pipe.

12 Claims, No Drawings

PIPE CLEANING COMPOSITION

The present invention relates to the removal of scale from metal surfaces, and especially to the removal of scale comprising metal oxides and carbonates from interior of pipes and other vessels employed for the transport or storage of aqueous fluids. More particularly, the present invention relates to an improved composition for removing scale from such metal surfaces which composition has a reduced tendency to attack the metal, and is particularly adaptable to the cleaning of scale from potable water systems.

Formation of scale on the interior surfaces of pipes, tubes, coils, tanks, heat exchangers, and other vessels has been a source of trouble where such pipes or vessels come in contact with aqueous liquid. the formation or deposition of scale markedly reduces the heat transfer through walls of such pipes or vessels and furthermore, the capacity of the pipes or vessels and the passage of fluids therethrough is restricted by the formation of such scale. Because of the scale formation on the inner surfaces of the pipes, particularly in the heat transfer appliances, pipes are subjected to excessive heat due to the loss in heat transfer capacity. Further, greater pressures are required to overcome the restricting effect of the deposited scale. These disadvantages often lead to leaks and rupture which necessitate undesirable down time and maintenance cost. Still further, the reduced cross-section of pipes caused by the deposition of scale can cause increased pressure drop, wherein the water pressure at the top of a multi-story building will approach zero.

Numerous attempts have been made to remove scale containing metal oxides and carbonates from the interior of pipes or fluid confining vessels. The more successful attempts have consisted of using aqueous solutions of known solvents for the compounds commonly found in the scale such as $Fe_2O_3$ and FeS, in combination with acidic materials which can react with the calcium carbonate and calcium oxide which comprises the balance of the scale. The use of hydrochloric acid solutions in concentration from about 1 to 25%, the balance being water, have been proposed, but such aqueous solutions usually lead to serious corrosion problems with respect to the pipes or water-confining vessels.

Strong acid solutions have been proposed by the prior art to dissolve scale, particularly calcium carbonate scale which is deposited on cooling towers and the metal surfaces of other systems and equipment for handling water. Such systems are designed to handle circulating water for cooling purposes, among other things, and in order to clean the systems the acid cleaning solutions generally must be circulated. The circulation causes aeration of the acid solutions which renders most prior art corrosion inhibitors virtually ineffective.

A common problem encountered in cleaning scale from pipes and small cooling towers and the like is that acid solutions, whether inhibited or not, tend to remove and dissolve copper from the copper surfaces of various elements of the system, and redeposit the copper on the steel surfaces. The presence of dissolved copper in the system is highly undesirable since it tends to plate out and cause severe galvanic attack of steel surfaces.

The present invention overcomes the disadvantages of the prior art through the use of an acid solution containing a combination of inhibitors which provide for reduced corrosion or dissolution of the copper, as well as reduced attack on steel surfaces. Using the compositions of the present invention, water systems, and particularly residential water systems fabricated from either galvanized steel or copper pipe, and which contain brass fittings in the form of valves and the like, can be cleaned and descaled, with a minimum amount of corrosion. The present invention contemplates pipe cleaning compositions which are fundamentally aqueous hydrochloric acid solutions containing a blend of inhibitors including furfural, diethylthiourea, and benzyl thiocyanate, and use of such compositions to remove scale of the type described above, while significantly minimizing the acid attack on either copper or galvanized steel pipe. In other words, the present invention provides for a composition which will remove scale from pipes without undue attack on the metal of the pipe, through the use of the novel combination of inhibitors employed in the present invention.

The present invention contemplates pipe cleaning compositions wich include hydrochloric acid, furfural, a dialkylthiourea and benzyl thiocyanate, the balance of the compositions being essentially water. More particularly, the present invention contemplates a pipe cleaning composition containing from about 7.5 to about 25 parts by weight of hydrochloric acid, 0.6 to 2.6 parts by weight of furfural, 0.5 to 1.4 parts by weight of dialkylthiourea, and 0.05 to 0.21 parts by weight of benzyl thiocyanate. In order to obtain the most effective inhibition of both copper and galvanized steel corrosion, it is essential to use all of these components, and that they be used in approximately the ratios set out above. Since the balance of the composition is essentially water, those skilled in the art will be aware that various ratios of dilution can be used for different purposes, depending upon the type of pipe or water holding vessel which is being cleaned. While it may be desirable to manufacture the pipe cleaning compositions of the present invention at higher concentrations than those set out above, prior to use the compositions should be diluted to the specified levels for most effective use.

It has been found that the addition of inhibitors to levels higher than specified above tends to increase the cost of the pipe cleaning compositions without increasing the effectiveness of the composition. Further, furfural is oily and has a bad odor, and use of more than about 2.6% by weight of furfural tends to cause a film of insoluble materail to be precipitated on the surface of the pipe being cleaned, which is particularly undesirable in domestic water systems. For these reasons, the amount of furfural used in the pipe cleaning composition should be kept as low as possible.

Benzyl thiocyanate produces a gummy, insoluble material if more than 0.5% is used, so that higher levels are not preferred. As is shown in table III, below, the benzyl thiocyanate is necessary to prevent corrosion of copper. While benzyl thiocyanate is not necessary to prevent the corrosion of steel alone, since virtually all water systems include some brass or copper valves or other fittings, the benzyl thiocyanate is considered to be an essential element of the composition, as a practical matter.

The thioureas of various types are slow to dissolve under some conditions. Therefore the use of higher quantities of thiourea require larger mixing time in the manufacture of the pipe cleaning compositions, and add to the cost thereof without a measurable improvement in the compositions.

As is indicated above, the composition must include a dialkylthiourea. It has been found that diethylthiourea produces the best results, although useful results have been achieved using dimethylthiourea, dibutylthiourea, diisopropylthiourea and diphenylthiourea. Those skilled in the art will be aware that other dialkylthioureas or materials which form such dialkylthioureas in the presence of water and acid may be used.

The preferred composition contemplated by the present invention for use in cleaning or removing scale from residential water systems is as follows:

| | Percent by Weight |
|---|---|
| HCl | about 10.0 |
| furfural | about 1.3 |
| diethylthiourea | about 0.7 |
| benzyl thiocyanate | about 0.1 |
| water | 87.9 |

In making up the compositions of the present invention, hydrochloric acid of various concentrations can be used, as will be known to those skilled in the art. The commercially available 37% hydrochloric acid has been found to be convenient. In making up the preferred composition, about 26.8 parts by weight of 37% hydrochloric acid are used with the described quantities of furfural, diethylthiourea and benzyl thiocyanate, the balance being essentially water. It has been found that this composition not only rapidly removes scale from residential water systems, but is greatly improved over the prior art systems insofar as corrosion inhibition is concerned.

The pipe cleaning compositions of the present invention may be produced by mixing the components in any desired order. It has been found advantageous to mix the acid first with dialkyl thiourea, followed by the addition of water. While this mixing step usually gives a clear solution, some dialkyl thiocyanates produce a milky solution. It is generally preferred to premix the furfural and benzyl thiocyanate, for convenience, which is then added to the acid solution. The present invention contemplates the use of various mechanical devices for mixing, including high speed dispersers and the like.

The following examples will serve to illustrate the preparation of several pipe cleaning compositions within the scope of the present invention, but it is understood that these examples are set forth merely for illustrative purposes and many other pipe cleaning compositions are within the scope of the present invention.

EXAMPLE 1A

A pipe cleaning composition was made up of the following materials:

| | Percent by Weight |
|---|---|
| hydrochloric acid (37%) | 26.78 |
| furfural | 1.30 |
| diethylthiourea | 0.72 |
| benzyl thiocyanate | 0.11 |
| water | 69.84 |

The pipe cleaning composition was produced by first mixing the hydrochloric acid with the diethylthiourea. This was then diluted with the given quantity of water and the furfural was added to this solution. Finally the benzyl thiocyanate was added with vigorous mixing.

A control solution was made up, which contained the same ingredients as shown above, but the benzyl thiocyanate was omitted.

The purpose of this test was to determine the relative ability of the two compositions to dissolve the scale, and for this purpose a small piece of flag stone was submerged in each solution. In order to eliminate the possiblity that one piece of flag stone was more soluble then the others, the pieces of stone were reversed after 20 minutes.

In each case, 112 grams of the solution of the present invention or the control solution were placed in a small beaker. To each solution was added a piece of flag stone weighing about 100 grams, and after 20 minutes the flag stones were removed, and the weight loss, in grams, was recorded. The flag stone pieces were then placed in the opposite solution, for 15 minutes, and the loss in weight was again recorded. The results of the test are shown in Table I.

TABLE I

| | Weight Loss | | | |
|---|---|---|---|---|
| | Solution of Present Invention | | Solution Without Benzyl thiocyanate | |
| Stage 1 | 5.7g | (Stone A) | 3.6g | (Stone B) |
| Stage 2 | 2.6g | (Stone B) | 4.8g | (Stone A) |
| Total Loss | 8.3g | | 8.4g | |

EXAMPLE 1B

Using the same solutions as are described in Example 1A, above, the flag stone pieces remaining from the test shown in Example 1A were submerged in fresh solutions (115 grams) of fresh solutions for 20 minutes, in the same order as the second phase of the test described in Example 1A. It is believed the weight loss of test 1B can be added to the weight loss in the first portion of test 1A to give a total weight loss based on the use of fresh solutions only. The results of this test are set forth in Table II below.

TABLE II

| | Weight Loss - Fresh Solution | | | |
|---|---|---|---|---|
| | Solution of Present Invention | | Solution Without Benzyl thiocyanate | |
| Stage 2 (fresh solution) | 3.1g | (Stone B) | 4.7g | (Stone A) |
| Total Loss | 8.8 | | 8.3 | |

Table II suggests that the pipe cleaning solution of the present invention is about as quick to attack certain types of lime stone or scale as is a similar solution containing no benzyl thiocyanate. It has been found in practical operations that the action of the pipe cleaning solution of the present invention is sufficiently rapid and complete for practical usage.

EXAMPLES 2–13

A series of solutions were prepared, within the scope of the present invention, to determine the effect of varying the concentration of inhibitors of the present invention. The solutions described in Table III were made up using 37% hydrochloric acid and the technique described in Example 1A.

Each of these solutions was divided into two parts. In one portion of each solution, a galvanized nipple was submerged for approximately 30 minutes. The amount of corrosion, as visually determined, is reported in table III. Solution No. 2, which represents the most preferred composition of the present invention, showed the least sign of attack of any, and represents the preferred composition for use in cleaning galvanized pipe. Solutions 10, and 11 showed a much greater attack of the zinc coated steel pipe than the solution No. 2. The balance of the solutions were attacked to a somewhat greater extent than solution No. 2, but in no case were they attacked as bad as solutions 10, or 11.

Using the second portion of each solution, a 2 inch long piece of 1 inch copper tubing was partially submerged in each solution and the resulting oxidation was observed. On the copper very little attack was observable after 1 hour, but at 24 and 48 hours there was pronounced oxidation observed as is shown. After 10 hours, solutions 2 through 9 showed relatively little oxidation on the copper, although solution No. 7 was the worst of these, and solution No. 3 showed a somewhat greater than average oxidation.

The oxidation of the copper pipe, after 48 hours, 72 hours, and 112 hours was observed, and after 112 hours the following results were observed:

TABLE III

| Example | HCl | Furfural | Diethyl-thiourea | Benzyl thiocyanate | Water | Affect on Galvanized after 1 hour | Affect on Copper after 24 hours |
|---|---|---|---|---|---|---|---|
| 2 | 60.74 (10.0%) | 2.95 (1.3%) | 1.63 (0.72%) | .24 (0.11%) | 161.23 | least attack | slight oxidation. |
| 3 | 60.74 (15.4%) | 2.95 (2%) | 1.63 (1.1%) | .24 (0.16%) | 80.61 | minor attack | slightly worse than No. 2. |
| 4 | 60.74 | 5.90 (2.6%) | 1.63 | .24 | 161.23 | very minor attack | slightly worse than No. 3. |
| 5 | 60.75 | 1.48 (0.66%) | 1.63 | .24 | 161.23 | greater attack than 4 | considerably worse than No. 4. |
| 6 | 60.74 | 2.95 | 3.26 (1.4%) | .24 | 161.23 | about equal to No. 2 after 20 mins. | approximately same as No. 2. |
| 7 | 60.74 | 2.95 | .82 (0.36%) | .24 | 161.23 | rapid attack | more oxidation than 2 or 6 after 24 hours; close to 11 after 48 hours. |
| 8* | 60.74 | 2.95 | 1.63 | .48 (0.21%) | 161.23 | minor attack | about same as No. 2. |
| 9 | 60.74 | 2.95 | 1.63 | .12 (0.05%) | 161.23 | minor attack | worse than No. 2. |
| 10 | 60.74 | 0 | 1.63 | .24 | 161.23 | great attack | severe oxidation. |
| 11 | 60.74 | 2.95 | 0 | .24 | 161.23 | rapid attack | more oxidation than No. 2 after 24 hours; at 48 hours considerably worse than 2 or 6. |
| 12 | 60.74 | 2.95 | 1.63 | 0 | 161.23 | minor attack | substantial oxidation-- worse than No. 2. |
| 13 | 60.74 | 2.95 | 3.26 (1.4%) | .12 (0.05%) | 161.23 | minor attack | about the same as No. 3. |

*increased Benzyl thiocyanate caused a gummy material to appear in the composition.

The data reported in table III demonstrates that the preferred composition, as given for solution No. 2, has a significantly reduced tendency to oxidize copper, while at the same time has a reduced tendency to attack steel. Table III also demonstrates that the furfural, the dialkylthiourea, and the benzyl thiocyanate are all essential to provide the maximum protection against corrosion, and that increasing the quantities of these materials above the preferred ranges does not significantly reduce the corrosion of the pipe cleaning composition.

EXAMPLE 14

A pipe cleaning composition as is set forth in Example 1 was made up. This was compared against a composition containing an equivalent amount of hydrochloric acid in water, but with no stabilizers or inhibitors being present. In this case two pieces of flag stone were used, one for each test solution. A piece of flag stone was submerged in one of the compositions being tested for 5 minutes and then removed, its weight loss being recorded. The flag stone was then placed in the other composition, and again the weight loss after 5 minutes was recorded. Finally, the flag stone pieces were returned to the composition they had been placed in initially, and left for 9 hours. Resulting weight losses are shown below in Table IV.

TABLE IV

| | Weight Loss Composition of present invention | | HCl no inhibitor | |
|---|---|---|---|---|
| Stage 1 (5 min.) | 1.8g | (Stone A) | 1.65 | (Stone B) |
| Stage 2 (5 min.) | 1.25g | (Stone B) | 2.5 | (Stone A) |
| Stage 3 (9 hours) | 10.3g | (Stone A) | 14.2 | (Stone B) |
| Total Loss | 13.35g | | 19.35g | |

While this experiment shows that the inhibitors of the present invention reduce the speed with which flag stone (and scale) is dissolved, this experiment also demonstrates that the inhibitors do not prevent the acid from working.

EXAMPLE 15

In order to compare the corrosion tendency of hydrochloric acid solutions with the compositions of the present invention, a ½ inch by 2 inch galvanized nipple was submerged in a hydrochloric acid solution for about one month and was compared against a similar nipple which had been submerged in the solution of Example 1 (both solutions had the same amount of hydrochloric acid) for one month. The nipple which had been submerged in the hydrochloric acid solution was badly rusted and both ends had been partially eaten away. The nipple which had been submerged in the composition of the present invention was discolored and showed a very small amount of rust, but the nipple was mechanically sound.

EXAMPLE 16

An experiment similar to Example 15 was carried out using a copper tee in lieu of the nipple. In this case, the copper tee which had been submerged in the hydrochloric acid showed great oxidation, large deposits of green copper oxide, and a considerably reduced wall thickness. From visual observation, it appeared that the wall thickness was reduced by about 50%. The tee which had been submerged in the composition of the present invention was discolored, but showed little, if any, oxidation and no observable reduction in wall thickness.

The compositions of the present invention are usable in the same manner as the various scale removal solutions of the prior art. This is generally accomplished by pumping the pipe cleaning solution through the pipes of the system being cleaned for an hour or more.

More particularly, in cleaning or descaling a residential water system, the water supply is shut off, and the water removed from the plumbing. A shower head is removed and capped at the highest point of the water system and by opening both the hot and cold valves on the capped shower, the pipe cleaning solution can be pumped up through the cold water system, whereupon it returns down through the hot water system or vice versa. The time of pumping will depend on the concentration of the acid in the pipe cleaning solution and is a function of the amount of scale actually present in the pipe. The actual technique by which this pipe cleaning solution is applied to the pipes is not critical with respect to the present invention although it is preferred to keep the time of contact as short as possible in order to minimize corrosion.

After the scale has been removed using the compositions of the present invention, it may be advisable to neutralize the cleaned pipe. After cleaning out domestic or residential water systems, it is necessary to thoroughly flush the acid and all inhibitors out of the system. In this regard, the present invention contemplates the use of neutralizing agents, baking soda, or the like to neutralize the acid.

In cleaning out systems which do not contain potable water, it may be desired to mix a small amount of the pipe cleaning solution of the present invention with the water therein in order to reduce or eliminate the possiblity of scale formation.

In addition to cleaning out residential water systems, the pipe cleaning composition of the present invention is useful in cleaning out humidifiers, vaporizers, shower heads, tea kettles, steam tables, air conditioners and similar water handling apparatus which is susceptible to scale formation.

The solutions of the present invention may be diluted with water, if desired, for some purposes. It has been found that diluting the pipe cleaning solutions will increase the amount of cleaning solution to be pumped, which may be an advantage if insoluble scale is encountered. In such cases the pumping of the increased volume of pipe cleaning solution will tend to carry the insoluble materials through the pipes, where the solids may be removed by filtration or sedimentation from the pipe cleaning solution. The present invention also contemplates the use of one or more organic solvents in the pipe cleaning composition in order to keep one or more of the inhibitors in solution and to help remove or dissolve some of the scale residue.

The pipe cleaning compositions of the present invention are preferably used at ambient temperatures or they may be used at elevated temperatures, if desired. While the use of elevated temperatures increases the speed with which the pipe cleaning composition acts, the advantage of the increase in speed is offset by the cost and trouble involved heating the cleaning composition and the pipe through which it is pumped.

As used herein, the term "parts by weight" shall not necessarily equal the percent by weight, except wherein so stated. Due to the nature of the present invention, the compositions may be diluted to alter the inhibitors or acids outside of the specified ranges, if said ranges were construed as percentages. Since the amount of water used in connection with the pipe cleaning compositions of the present invention may vary considerably, the ratios are expressed in parts by weight.

The forms of invention herein shown and described are to be considered only as illustrative. It will be apparent to those skilled in the art that numerous modifications may be made therein without departure from the spirit of the invention or the scope of the appended claims.

I claim:

1. A pipe cleaning composition comprising an aqueous solution containing from about 7.5 to 25 parts by weight of hydrochloric acid, and a combination of inhibitors consisting essentially of 0.6 to 2.6 parts by weight of furfural, 0.5 to 1.4 parts by weight of a dialkylthiourea wherein the alkyl groups contain up to about 4 carbon atoms, and 0.05 to 0.21 parts by weight of benzyl thiocyanate.

2. A pipe cleaning composition as described in claim 1, wherein the dialkylthiourea is diethylthiourea.

3. A pipe cleaning composition which essentially consists of:

| | Parts by Weight |
|---|---|
| hydrochloric acid | 7.5 to 25 |
| furfural | 0.6 to 2.6 |
| dialkylthiourea wherein the alkyl groups contain up to about 4 carbon atoms | 0.5 to 1.4 |
| benzyl thiocyanate | 0.05 to 0.21, |

the balance consisting essentially of water.

4. A pipe cleaning composition as described in claim 3, wherein the dialkylthiourea is diethylthiourea.

5. A pipe cleaning composition as described in claim 4, which comprises:

| | Parts by Weight |
|---|---|
| HCl | about 10 |
| furfural | about 1.3 |
| diethylthiourea | about 0.7 |
| benzyl thiocyanate | about 0.1, |

the balance being essentially water.

6. A method of removing a scale deposit from metal surfaces normally in contact with water, which deposit includes at least one alkaline earth metal carbonate, which method comprises contacting said scale deposit with an aqueous composition containing from about 7.5 to 25 parts by weight of hydrochloric acid, and a combination of inhibitors consisting essentially of about 0.6 to 2.6 parts by weight of furfural about 0.5 to 1.4 parts by weight of dialkylthiourea wherein the alkyl groups contain up to about 4 carbon atoms, and about 0.05 to 0.21 parts by weight of benzyl thiocyanate, whereby said deposit is dissolved and/or dispersed.

7. A method as described in claim 6, wherein said dialkylthiourea is diethylthiourea.

8. A method as described in claim 6, wherein said composition is continuously circulated in contact with said scale deposit.

9. A method as described in claim 8, wherein said dialkylthiourea is diethylthiourea.

10. A method of inhibiting scale formation in circulating water systems which comprises forming scale inhibiting solution by adding to the water in said system a small amount of a composition containing from about 7.5 to 25 parts by weight of hydrochloric acid, and a combination of inhibitors consisting essentially of about 0.6 to about 2.6 parts by weight of furfural, about 0.5 to 1.4 parts by weight of dialkylthiourea wherein the alkyl groups contain up to about 4 carbon atoms, and about 0.05 to 0.21 parts by weight of benzyl thiocyanate and circulating said solution through said system.

11. A method as described in claim 10, wherein said dialkylthiourea is diethylthiourea.

12. A method as described in claim 10, wherein said water system is a closed system.

* * * * *